United States Patent [19]

Kurosawa et al.

[11] 4,210,790

[45] Jul. 1, 1980

[54] VACUUM-TYPE CIRCUIT INTERRUPTER

[75] Inventors: Yukio Kurosawa; Hiroyuki Sugawara; Yukio Kawakubo, all of Hitachi, Japan

[73] Assignee: Hitachi, Ltd., Japan

[21] Appl. No.: 802,941

[22] Filed: Jun. 2, 1977

[30] Foreign Application Priority Data

Jun. 9, 1976 [JP] Japan ..... 51-67339

[51] Int. Cl.[2] ..... H01H 33/66

[52] U.S. Cl. ..... 200/144 B

[58] Field of Search ..... 200/144 B

[56] References Cited

U.S. PATENT DOCUMENTS 3,764,764 10/1973 Takasuna et al. ..... 200/144 B 3,980,850 9/1976 Kimblin ..... 200/144 B 4,004,117 1/1977 Amsler ..... 200/144 B

*Primary Examiner*—Robert S. Macon

*Attorney, Agent, or Firm*—Craig and Antonelli

[57] ABSTRACT

A pair of relatively movable opposed electrodes for use in a vacuum-type circuit interrupter, each electrode comprising an annular contact-making portion provided at its outer peripheral area, a recessed portion surrounded by this annular contact-making portion, first self-acting magnetically-driving means for driving an arc produced on the surface of the annular contact-making portion to impel the same in a circumferential direction, and second self-acting magnetically driving means for driving an arc produced on the surface of the recessed portion to impel the same toward and onto the surface of the contact-making portion.

44 Claims, 13 Drawing Figures

VACUUM-TYPE CIRCUIT INTERRUPTER

BACKGROUND OF THE INVENTION

This invention relates to the structure of electrodes for use in vacuum-type circuit interrupters, and more particularly to the electrode structure of the self-acting magnetically-driving type.

Electrodes for use in a vacuum-type circuit interrupter are generally provided with a plurality of slots for controlling the flow of current through the electrodes. These slots act to establish a parallelly reciprocating loop-like current path extending substancially in a circumferential direction of the electrodes, and a magnetic field thereby produced is utilized to impel an arc for avoiding objectionable local fusion of the electrodes to improve the circuit interruption performance of the circuit interrupter.

In the electrodes for use in the vacuum-type circuit interrupter, their contact-making surface serves also as an arc-running surface so that an arc can be strongly impelled by a magnetically driving force as soon as such an arc is produced. More precisely, as disclosed in, for example, U.S. Pat. No. 3,764,764, each of a pair of electrodes has an outer peripheral arc-running surface protruding toward the corresponding arc-running surface of the other, and its central area is recessed relative to the arc-running surface so that the electrode can make contact at its arc-running surface with the arc-running surface of the other.

However, such a prior art electrode structure has been defective in that interruption of a large current gives rise to a shift of an arc toward and onto the central area of the electrodes resulting in impossibility of exhibiting the desired circuit interruption performance.

SUMMARY OF THE INVENTION

It is a primary object of the present invention to provide a novel and improved electrode structure for use in a vacuum-type circuit interrupter, which obviates the aforementioned prior art defect and ensures an excellent circuit interruption performance.

In accordance with the present invention which attains the above object, there is provided a pair of relatively movable opposed electrodes for use in a vacuum-type circuit interrupter, each electrode comprising an annular contact-making portion provided at its outer peripheral area, a recessed portion surrounded by this annular contact-making portion, first self-acting magnetically-driving means for driving an arc produced on the surface of the annular contact-making portion to impel the same in a circumferential direction, and second self-acting magnetically-driving means for driving an arc produced on the surface of the recessed portion to impel the same toward and onto the surface of the contact-making portion.

BRIEF DESCRIPTION OF THE DRAWINGS

Other objects, features and advantages of the present invention will become clear from the following detailed description taken in conjunction with the accompanying drawings, in which.

DESCRIPTION OF THE PRIOR ART

For a better understanding of the present invention, defects of a prior art electrode structure will be described in detail before describing preferred embodiments of the present invention.

Figure 1:
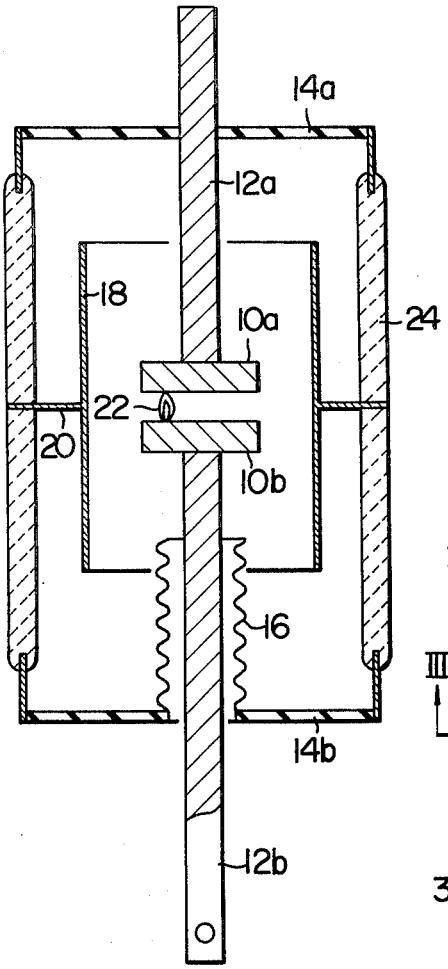
FIG. 1 is a schematic vertical sectional view showing the construction of a vacuum-type circuit interrupter employing a pair of electrodes to which the present invention is directed.

FIG. 1 is a schematic vertical sectional view showing the construction of a vacuum-type circuit interrupter to which the present invention is applied.

Referring to FIG. 1, a pair of contacts or electrodes 10*a* and 10*b* are securely fixed to one end of a pair of support rods or holders 12*a* and 12*b* of electrical conductor respectively within a sealed envelope, and these electrically conductive holders 12*a* and 12*b* extend at the other end toward the exterior through a pair of end plates 14*a* and 14*b* respectively of the sealed envelope. The sealed envelope comprises a cylindrical casing 24 of electrical insulator the opposite ends of which are closed by the end plates 14*a* and 14*b*. At least one of the conductive holders 12*a* and 12*b*, for example, the holder 12*b* is movable relative to the holder 12*a*, and a vacuum-tight seal therefor is provided by a bellows 16, while the stationary holder 12*a* is sealed vacuum-tight directly at the portion penetrating the end plate 14*a*. The sealed envelope is evacuated to a high vacuum of $1\times10^{-5}$ Torr or lower. A shield 18 is supported in the middle portion of the internal space of the cylindrical casing 24 by shield supports 20 in such a manner as to surround the electrodes 10*a* and 10*b* so that metal vapor vaporizing from the electrodes 10*a* and 10*b* parting during interruption of current may not attach to the inner wall of the cylindrical casing 24. An arc 22 jumps across the electrodes 10*a* and 10*b* upon current interruption.

Figure 2:
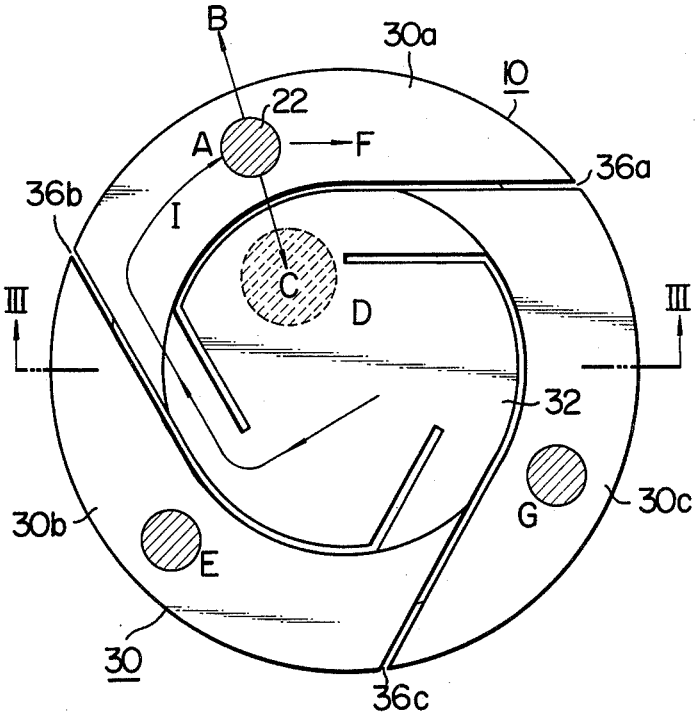
FIG. 2 PRIOR ART
FIG. 2 is a plan view of a prior art electrode employed in a vacuum-type circuit interrupter as shown in FIG. 1.
Figure 3:
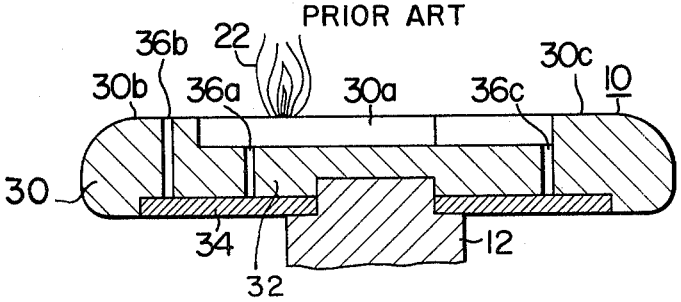
FIG. 3 PRIOR ART
FIG. 3 is a vertical sectional view taken along the line III—III in FIG. 2.

FIG. 2 is a plan view of one form of one of a pair of prior art electrodes employed in a vacuum-type circuit interrupter as shown in FIG. 1, and FIG. 3 is a vertical sectional view taken along the line III—III in FIG. 2. Such an electrode is disclosed in detail in the aforementioned U.S. Pat. No. 3,764,764 and will not therefore be described in detail in this specification.

Referring to FIGS. 2 and 3, an electrode generally designated by reference numeral 10 is securely fixed to one end of a support rod or holder 12 of electrical conductor. The electrode 10 comprises an annular portion 30 including a contact-making surface for making contact with the corresponding contact-making surface of the other opposite electrode, and a disc-shaped recessed portion 32 surrounded by the annular portion 30. A reinforcing member 34 of material having a relatively high resistivity is disposed on the other surface of the electrode 10 to limit the direction of current flow. The electrode 10 is formed with a plurality of current-limiting slots 36*a*, 36*b* and 36*c* each having a depth extending to the reinforcing member 34. The contact-making surface of the annular portion 30 is divided into a plurality of contact-making surface segments 30*a*, 30*b* and 30*c* by these slots 36*a*, 36*b* and 36*c*, and these contact-making surface segments 30*a*, 30*b* and 30*c* serve also as arc-running surface segments where an arc runs when such an arc is produced as a result of current interruption.

Suppose now that an arc 22 is produced at a point A on the arc-running surface segment 30*a* upon current interruption. Then, an arc current I flowing from the conductive holder 12 passes through a route as illustrated in FIG. 2 to flow into the corresponding arc-running surface segment of the other electrode, thence, it passes through a route reverse to the illustrated route to flow into the conductive holder connected to the other electrode. Thus, the arc current I is forced to follow the illustrated route by being limited by the slots 36*a* and 36*b*, and current paths running in parallel with each other are formed between the pair of opposed electrodes. The arc 22 is thus impelled in a circumferential direction by the magnetically driving force F produced by the current I. Neutral atoms of vaporized metal and some of metal ions emanating from the arc 22 diffuse radially outward as shown by the arrow B and also radially inward as shown by the arrow C in FIG. 2.

In the case of interruption of a large current, arcs may also appear on the arc-running surface segments 30*b* and 30*c* simultaneously as shown at points E and G in addition to the point A on the arc-running surface segment 30*a*. Thus, part of vaporized metal atoms and charged particles emanating from these arcs diffuse radially inward in FIG. 2. Further, due to the fact that the arcs are located on all the arc-running regions 30*a*, 30*b* and 30*c*, a magnetic field of very high intensity appears in the space between the arc-running surface segments 30*a*, 30*b* and 30*c* of the opposed electrodes.

The charged particles diffusing radially inward, that is, toward the central area of the electrode 10 from, for example, the arc-running surface segment 30*a* in such a situation pass over the central area to diffuse toward the opposite arc-running surface segment 30*b* or 30*c*, and the diffusing direction of the charged particles is then reversed by the magnetic mirror effect of the intense magnetic field established at the arc-running running surface segments, so that the charged particles return to the central area of the electrode 10 again. As a result, the charged particle density is gradually increased in the central area of the electrode 10. The charged particle density becomes especially high at, for example, a point D which is the center of greatest curvature of the illustrate current route, resulting in undesirable generation of an arc at this point too. Generation of such an arc at this point gives rise to shorting of the impedance of the current path which has been formed through the arc-running surface segment 30*a*, and the current is concentrated in this area at the point D. The magnetically driving effect disappears now, and fusion of the electrode 10 at this area occurs resulting in impossibility of current interruption.

It will thus be seen that the vacuum-type circuit interrupter employing the prior art electrode structure is defective in that an increase in the value of interrupted current gives rise to a shift of an arc toward the central area of the electrode resulting in an unsatisfactory interruption performance or impossibility of current interruption.

DETAILED DESCRIPTION OF THE PREFERRED EMBODIMENTS

Some preferred embodiments of the present invention will now be described in detail with reference to FIGS. 4 to 13.

An embodiment of the present invention will be described in detail with reference to FIGS. 4 to 6.

Figure 4:
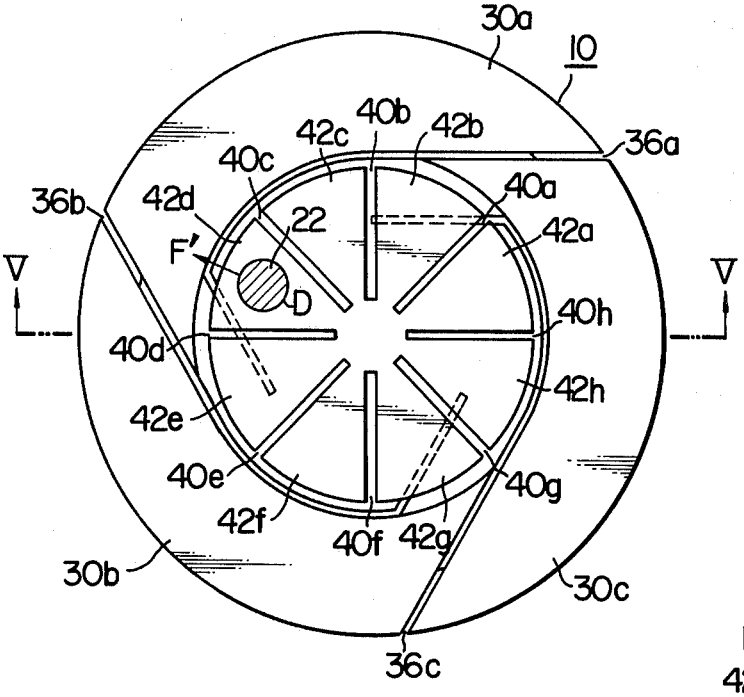
FIG. 4 is a plan view of an embodiment of the electrode of the present invention for use in a vacuum-type circuit interrupter as shown in FIG. 1.
Figure 5:
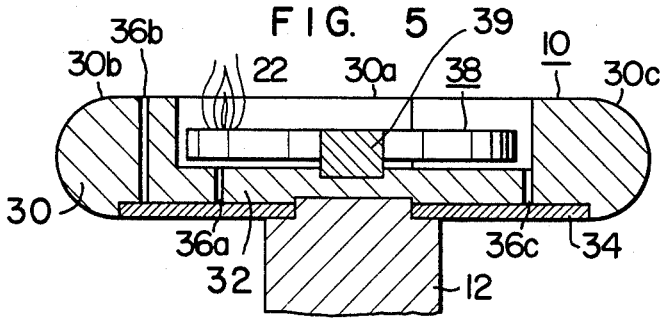
FIG. 5 is a vertical sectional view taken along the line V—V in FIG. 4.
Figure 6:
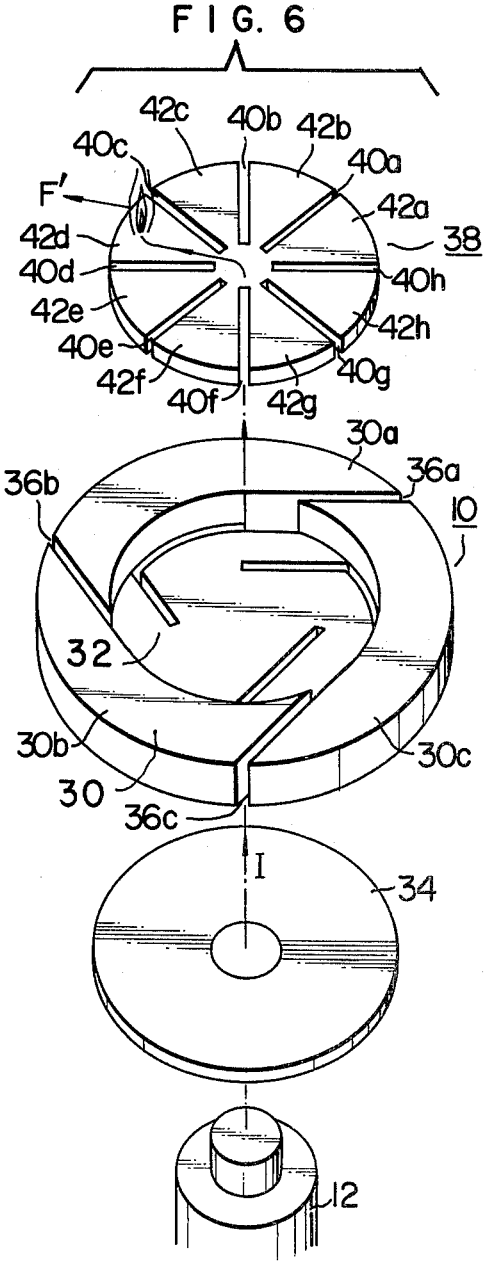
FIG. 6 is an exploded perspective view of the electrode structure shown in FIG. 4.

Referring to FIGS. 4 to 6, the electrode according to a first embodiment of the present invention is designated generally by reference numeral 10 and is of the magnetically driving type similar to the prior art one shown in FIGS. 2 and 3 in that it comprises an annular portion 30 providing a contact-making surface thereon and a central disc-shaped recessed portion 32 surrounded by the annular portion 30. A plurality of slots 36*a*, 36*b* and 36*c* are formed through the annular and recessed portions to divide the contact-making surface into a plurality of contact-making surface segments 30*a*, 30*b* and 30*c* which serve also as arc-running surface segments, thereby forming a parallelly-reciprocating-loop-like current path. However, the electrode 10 according to the present invention differs from the prior art one in that a second or auxiliary electrode 38 of the magnetic driving type is additionally disposed in its central recess. Reference numerals 34 and 12 in FIGS. 5 and 6 designate a reinforcing member and a conductive support rod or holder similar to those shown in FIG. 3 respectively.

The auxiliary electrode 38 of the magnetic driving type is provided with a central portion 39 and with a plurality of slots 40*a* to 40*h* extending radially outward from the central area thereby forming a plurality of radially directed arc-running surface segments 42*a* to 42*h*. These arc-running surface segments 42*a* to 42*h* are located at a level lower than that of the arc-running surface segments 30*a* to 30*c* of the electrode 10 so that they may not contact the corresponding arc-running surface segments of the other electrode.

Suppose that an arc 22 is produced at a point D on the arc-running surface segment 42*d* in the central area of the electrode 10 having such a structure. Then, by virtue of the provision of the second or auxiliary electrode 38 of the magnetically driving type, an arc current I flowing along a route as shown in FIG. 6 flows through parallel current paths provided by the pair of opposed auxiliary electrodes of the magnetically driving type, and the arc 22 is driven radially outward by the magnetically driving force F′ produced by the current I to return onto the arc-running surface segment 30*a* of the main electrode 10 again. Therefore, the present invention obviates impossibility of circuit interruption as encountered with the prior art electrode structure due to the shift of an arc toward the central area of the electrode. According to the present invention, further, the arc is effectively magnetically impelled along the arc-running surface segments thereby greatly improving the current interruption performance.

Figure 7:
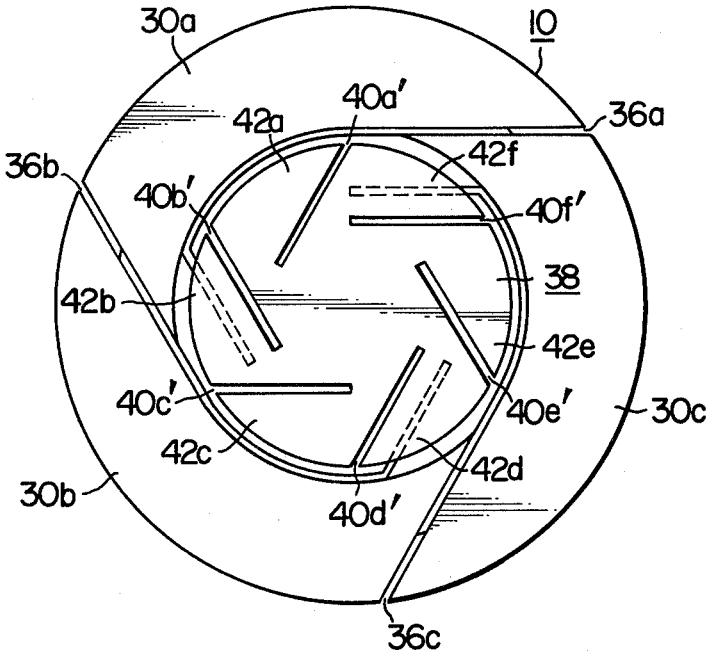
FIG. 7 is a plan view of another embodiment of the electrode according to the present invention.
Figure 8:
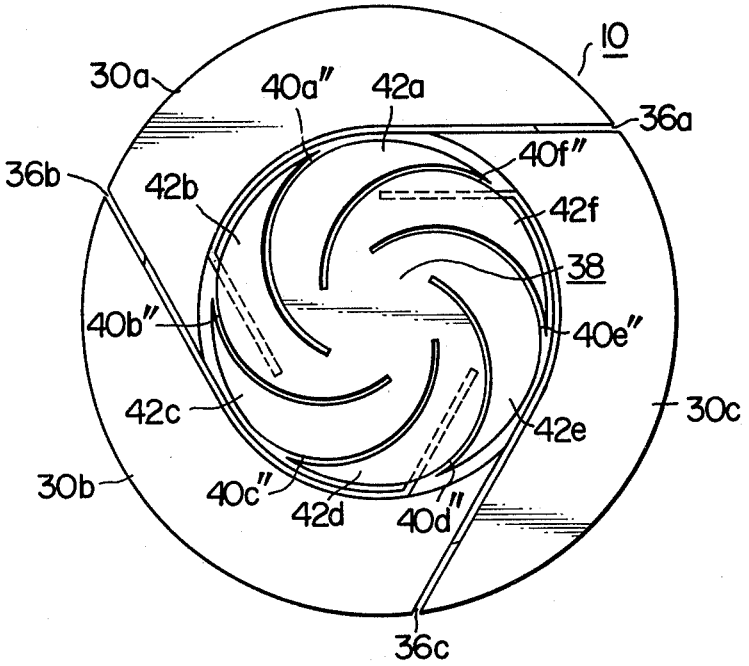
FIG. 8 is a plan view of still another embodiment of the electrode according to the present invention.

FIG. 7 shows another embodiment of the present invention. This second embodiment is a modification of the first embodiment, and as will be seen in FIG. 7, the second or auxiliary electrode 38 of the magnetically driving type is provided with a plurality of slots 40*a'* to 40*f'* which extend straight at an angle with respect to the radius. FIG. 8 shows still another embodiment of the present invention. This third embodiment is another modification of the first embodiment, and as will be seen in FIG. 8, the second or auxiliary electrode 38 of the magnetically driving type is provided with a plurality of spiral slots 40*a''* to 40*f''*. It is apparent that the effect of the second and third embodiments shown in FIGS. 7 and 8 is entirely similar to that of the first embodiment shown in FIGS. 4 to 6.

Figure 9:
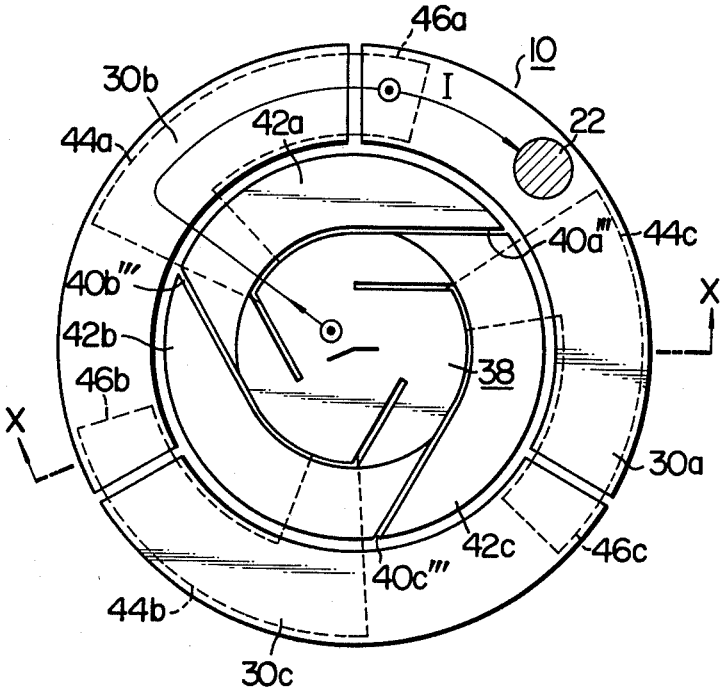
FIG. 9 is a plan view of a further embodiment of the electrode according to the present invention.
Figure 10:
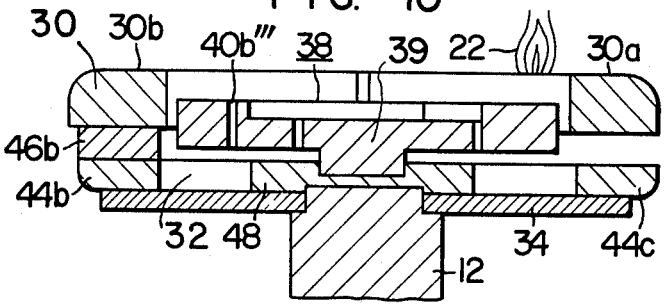
FIG. 10 is a vertical sectional view taken along the line X—X in FIG. 9.
Figure 11:
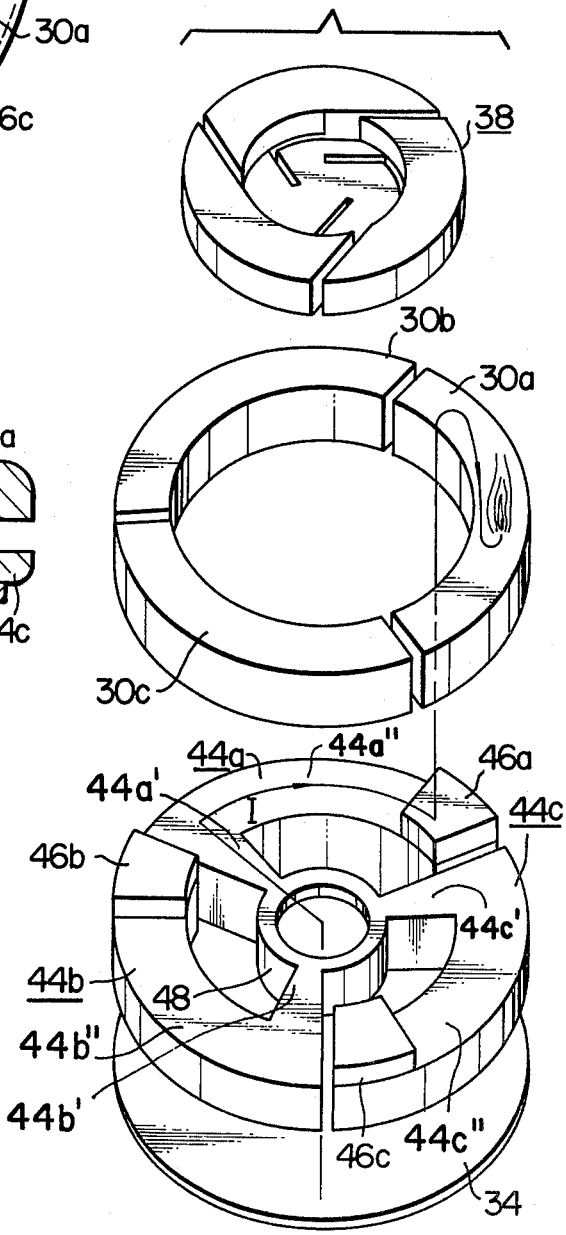
FIG. 11 is an exploded perspective view of the electrode structure shown in FIG. 9.

FIGS. 9 to 11 show yet another embodiment of the present invention and represent an application of the present invention to a magnetically driving type electrode structure in which a first or main electrode 10 comprises a plurality of arc-running surface segments 30*a*, 30*b* and 30*c* overlapping respectively a plurality of L-shaped arms 44*a*, 44*b* and 44*c* respectively having leg portions 44*a'*, 44*b'* and 44*c'* which extend radially from a body portion 48 secured to a conductive support rod or holder 12 and arm portions 44*a''*, 44*b''* and 44*c''* which extend circumferentially from the respective radial ends of the leg portions, as clearly shown in FIG. 11. The contact-making surface segments 30*a*, 30*b* and 30*c* and the arm portions 44*a''*, 44*b''* and 44*c''* form an annular portion 30, and the leg portions 44*a'*, 44*b'* and 44*c'* form a recessed portion 32 surrounded by the annular portion 30, similarly to the previous embodiments. The electrode structure shown in FIGS. 9 to 11 comprises a second or auxiliary electrode 38 of the magnetically driving type which is analogous to the prior art electrode shown in FIGS. 2 and 3. A plurality of slots 40*a'''*, 40*b'''* and 40*c'''* are formed in the auxiliary electrode 38, and a plurality of connecting pieces 46*a*, 46*b* and 46*c* of electrical conductor are provided to electrically connect the L-shaped arms 44*a*, 44*b* and 44*c* to the arc-running surface segments 30*a*, 30*b* and 30*c* respectively of the main electrode 10. A reinforcing member 34 similar to that described with reference to FIGS. 4 to 6 is also provided.

Suppose now that an arc 22 is produced on the arc-running surface segment 30*a* in the vacuum-type circuit interrupter having such an electrode structure. Then, an arc current I flowing upon current interruption follows a route which is traced from the conductive support rod or holder 12 to the arc 22 via the body portion 48, L-shaped arm 44*a*, connecting piece 46*a* and arc-running surface segment 30*a*. A route symmetrical to that above described is established in the other electrode, and these parallel current paths act to impel the arc circumferentially of the arc-running surface segments of the opposed electrodes.

Although the connecting pieces 46*a*, 46*b* and 46*c* are illustrated as being fabricated separately from the associated arms 44*a*, 44*b* and 44*c*, they may be fabricated as an integral part of the respective arms.

Possibility of shifting of the arc 22 toward the central area of the second or auxiliary electrode 38 is obviated in this embodiment, because the arc-running surface segments 30*a*, 30*b* and 30*c* of the first or main electrode 10 are disposed in close proximity to the arc-running surface segments 42*a*, 42*b* and 42*c* of the auxiliary electrode 38, and the arc itself tends to be impelled radially outward by the inertia of the revolving movement caused by the magnetic driving force. Thus, an arc which may be produced on any one of the arc-running surface segments 42*a*, 42*b* and 42*c* of the auxiliary electrode 38 is returned to the previous location on the arc-running surface segment 30*a*, 30*b* or 30*c* of the main electrode 10 before such an arc is shifted toward and onto the central axis of the auxiliary electrode 38. Therefore, the effect exhibited by the fourth embodiment is also entirely similar to that of the first embodiment described with reference to FIGS. 4 and 5.

Figure 12:
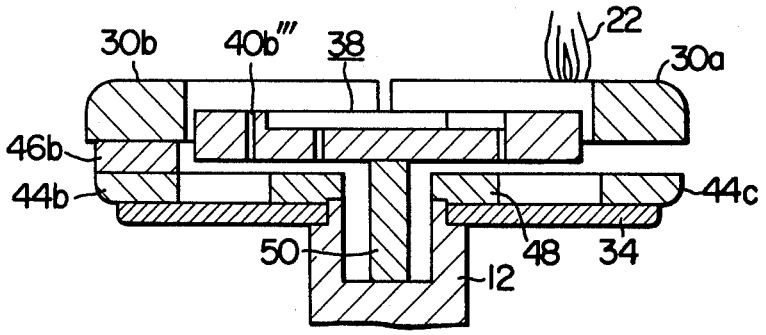
FIG. 12 is a vertical sectional view of another embodiment of the electrode according to the present invention.

FIG. 12 shows a modification of the fourth embodiment of the present invention shown in FIGS. 9 to 11. Referring to FIG. 12, the second or auxiliary electrode 38 is supported on a holder 50 of material having a relatively high resistivity secured to the conductive support rod or holder 12, so that this holder 50 acts to limit current flowing into the auxiliary electrode 38. Thus, a current of large value exceeding the interrupting ability of the auxiliary electrode 38 is prevented from flowing into the auxiliary electrode 38, and the function of the auxiliary electrode 38 becomes more effective. The structural feature of this embodiment may of course be applied to the first to third embodiments.

In the embodiments shown in FIGS. 9 to 12, the second or auxiliary electrode 38 has been illustrated as having a pan-like shape similar to the prior art electrode shown in FIGS. 2 and 3. However, it is apparent that the auxiliary electrode 38 is in no way limited to such a specific shape, and any one of the auxiliary electrodes used in the embodiments shown in FIGS. 4 to 8 may be equally effectively employed. Further, it will be easily understood that in lieu of the auxiliary electrodes 38 of flat shape employed in the embodiments shown in FIGS. 4 to 8, the auxiliary electrode of pan-like shape shown in FIGS. 9 to 12 may be used.

Figure 13:
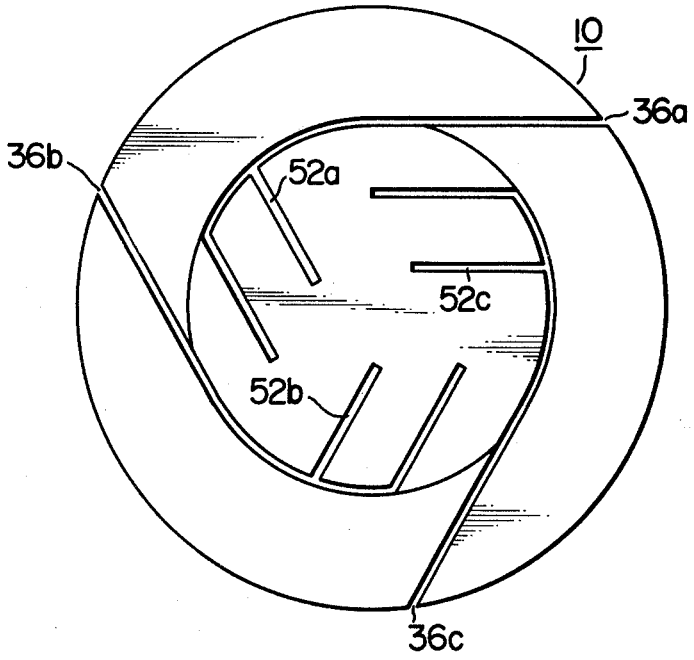
FIG. 13 is a plan view of still another embodiment of the electrode according to the present invention.

In each of the aforementioned embodiments, the second or auxiliary electrode 38 is provided as a means for impelling an arc produced in the central recess of the main electrode 10 toward and onto the outer peripheral arc-running surface segments 30*a*, 30*b* and 30*c* of the main electrode 10. However, such a means may not comprise the auxiliary electrode 38 and may comprise a plurality of self-acting magnetically driving slots 52*a* to 52*c* which, as shown in FIG. 13, extend from the central area toward the outer peripheral area of the electrode 10 and are provided in addition to the slots 36*a* to 36*c*. This magnetically driving means is also effective in attaining the effect substantially similar to that exhibited by the individual embodiments.

It will be understood from the foregoing detailed description that the present invention provides, in a vacuum-type circuit interrupter of the self-acting magnetically driving type, an electrode structure having an outer peripheral arc-running surface serving also as a contact-making surface and having a central recess, wherein additional self-acting magnetically driving means is provided for impelling an arc produced in the central recess toward and onto the contact-making surface. The present invention having such a feature can completely obviate the impossibility of current interruption encountered with the prior art electrode structure due to the shift of an arc toward the central area of the electrode. Thus, according to the present invention, an arc can be effectively magnetically driven along the arc-running surface thereby greatly improving the current interruption performance.

We claim:

1. In a vacuum-type circuit interrupter having a pair of relatively movable opposed electrodes carried respectively by electrically conductive support members, each of said electrodes having a structure comprising:

an annular portion having opposite annular surfaces, one of said annular surfaces providing an annular contact-making surface which separably makes contact with the corresponding contact-making surface of the other opposite electrode and acts as an arc-running surface upon actuation of said circuit interrupter to break the circuit therethrough;

a substantially disc-shaped recessed portion surrounded by said annular portion and having substantially circular opposite surfaces, said disc-shaped portion being secured to said support member at the central area of one of said substantially circular opposite surfaces thereof, the other substantially circular surface being sunk below said contact-making surface to provide a sunk surface untouchably opposing the corresponding sunk surface of the opposite electrode;

first self-acting magnetically driving means for driving an arc produced on said contact-making surface to impel the same in a circumferential direction of said contact-making surface; and second self-acting magnetically driving means for driving an arc produced at the recessed portion surrounded by said annular portion to shift the same toward and onto said contact-making surface.

2. An electrode structure as claimed in claim 1, wherein said first self-acting magnetically driving means comprises a plurality of slots extending from the central area of said disc-shaped portion to the outer peripheral edge of said annular portion to limit the direction of current flow, and wherein said second self-acting magnetically driving means comprises a substantially disc-shaped auxiliary electrode portion received in said recessed portion defined by said annular portion and said sunk surface, said auxiliary electrode portion having substantially circular opposite surfaces and being electrically conductively supported at the central area of one of said opposite surfaces thereof on the central area of said sunk surface of said disc-shaped portion, the other one of said opposite surfaces of said auxiliary electrode portion being sunk below said contact-making surface to untouchably oppose the corresponding surface of the auxiliary electrode portion of the other opposite electrode, said auxiliary electrode portion being provided with a plurality of slots extending from its central area to its outer peripheral edge to limit the direction of current flow.

3. An electrode structure as claimed in claim 2, wherein said plural slots provided on said auxiliary electrode portion extend substantially straight in radial directions from the central area to the outer peripheral edge of said auxiliary electrode portion.

4. An electrode structure as claimed in claim 2, wherein said plural slots provided on said auxiliary electrode portion extend substantially straight from the central area to the outer peripheral edge of said auxiliary electrode portion while making an angle with respect to the radius.

5. An electrode structure as claimed in claim 2, wherein said plural slots provided on said auxiliary electrode portion extend substantially arcuately from the central area to the outer peripheral edge of said auxiliary electrode portion.

6. An electrode structure as claimed in claim 2, wherein a circular recess is formed concentrically on said the other surface of said auxiliary electrode portion.

7. An electrode structure as claimed in claim 2, wherein said one surface of said disc-shaped portion and the other annular surface of said annular portion are disposed in flush relation with each other to be covered with a reinforcing member of electrically resistive material, and said plural slots extending from the central area of said disc-shaped portion to the outer peripheral edge of said annular portion have such a depth that they extend from said sunk surface and said contact-making surface to said reinforcing member.

8. An electrode structure as claimed in claim 3, wherein said one surface of said disc-shaped portion and the other annular surface of said annular portion are disposed in flush relation with each other to be covered with a reinforcing member of electrically resistive material, and said plural slots extending from the central area of said disc-shaped portion to the outer peripheral ege of said annular portion have such a depth that they extend from said sunk surface and said contact-making surface to said reinforcing member.

9. An electrode structure as claimed in claim 4, wherein said one surface of said disc-shaped portion and the other annular surface of said annular portion are disposed in flush relation with each other to be covered with a reinforcing member of electrically resistive material, and said plural slots extending from the central area of said disc-shaped portion to the outer peripheral edge of said annular portion have such a depth that they extend from said sunk surface and said contact-making surface to said reinforcing member.

10. An electrode structure as claimed in claim 5, wherein said one surface of said disc-shaped portion and the other annular surface of said annular portion are disposed in flush relation with each other to be covered with a reinforcing member of electrically resistive material, and said plural slots extending from the central area of said disc-shaped portion to the outer peripheral edge of said annular portion have such a depth that they extend from said sunk surface and said contact-making surface to said reinforcing member.

11. An electrode structure as claimed in claim 6, wherein said one surface of said disc-shaped portion and the other annular surface of said annular portion are disposed in flush relation with each other to be covered with a reinforcing member of electrically resistive material, and said plural slots extending from the central area of said disc-shaped portion to the outer peripheral edge of said annular portion have such a depth that they extend from said sunk surface and said contact-making surface to said reinforcing member.

12. An electrode structure as claimed in claim 2, wherein said auxiliary electrode portion is coupled to said disc-shaped portion through an electrically resistive material.

13. An electrode structure as claimed in claim 3, wherein said auxiliary electrode portion is coupled to said disc-shaped portion through an electrically resistive material.

14. An electrode structure as claimed in claim 4, wherein said auxiliary electrode portion is coupled to said disc-shaped portion through an electrically resistive material.

15. An electrode structure as claimed in claim 5, wherein said auxiliary electrode portion is coupled to said disc-shaped portion through an electrically resistive material.

16. An electrode structure as claimed in claim 6, wherein said auxiliary electrode portion is coupled to said disc-shaped portion through an electrically resistive material.

17. An electrode structure as claimed in claim 7, wherein said auxiliary electrode portion is coupled to said disc-shaped portion through an electrically resistive material.

18. An electrode structure as claimed in claim 8, wherein said auxiliary electrode portion is coupled to said disc-shaped portion through an electrically resistive material.

19. An electrode structure as claimed in claim 9, wherein said auxiliary electrode portion is coupled to said disc-shaped portion through an electrically resistive portion.

20. An electrode structure as claimed in claim 10, wherein said auxiliary electrode portion is coupled to said disc-shaped portion through an electrically resistive material.

21. An electrode structure as claimed in claim 11, wherein said auxiliary electrode portion is coupled to said disc-shaped portion through an electrically resistive material.

22. An electrode structure as claimed in claim 1, wherein said substantially disc-shaped portion comprises a central disc-shaped body, and a plurality of legs extending radially therefrom, and said annular portion comprises a plurality of arms each extending in one circumferential direction from the radial end of one of said plural legs but terminating in a position circumferentially spaced apart from the adjacent arm, and a plurality of contact-making surface segments each being electrically connected to and supported by one of said plural arms at the free end of said arm and extending in said one circumferential direction from said free end of said arm without making contact with the other arms but terminating in a position circumferentially spaced apart from the adjacent segment thereby providing said first self-acting magnetically driving means, and wherein said second self-acting magnetically driving means comprises a disc-shaped auxiliary electrode portion received in said recessed portion, said auxiliary electrode portion having substantially circular opposite surfaces and being electrically conductively supported at the central area of one of said opposite surfaces thereof on said central disc-shaped body, the other one of said opposite surfaces of said auxiliary electrode portion being sunk below said contact-making surface to untouchably oppose the corresponding sunk surface of the auxiliary electrode portion of the other opposite electrode, said auxiliary electrode portion being provided with a plurality of slots extending from its central area to its outer peripheral edge to limit the direction of current flow.

23. An electrode structure as claimed in claim 22, wherein said plural slots provided on said auxiliary electrode portion extend substantially straight in radial directions from the central area to the outer peripheral edge of said auxiliary electrode portion.

24. An electrode structure as claimed in claim 22, wherein said plural slots provided on said auxiliary electrode portion extend substantially straight from the central area to the outer peripheral edge of said auxiliary electrode portion while making an angle with respect to the radius.

25. An electrode structure as claimed in claim 22, wherein said plural slots provided on said auxiliary electrode portion extend substantially arcuately from the central area to the outer peripheral edge of said auxiliary electrode portion.

26. An electrode structure as claimed in claim 22, wherein a circular recess is formed concentrically on said the other surface of said auxiliary electrode portion.

27. An electrode structure as claimed in claim 22, wherein said one surface of said central disc-shaped body and said legs constituting said disc-shaped portion and one of the surfaces of said arms are disposed in flush relation with each other to be covered with a reinforcing member of electrically resistive material.

28. An electrode structure as claimed in claim 23, wherein said one surface of said central disc-shaped body and said legs constituting said disc-shaped portion and one of the surfaces of said arms are disposed in flush relation with each other to be covered with a reinforcing member of electrically resistive material.

29. An electrode structure as claimed in claim 24, wherein said one surface of said central disc-shaped body and said legs constituting said disc-shaped portion and one of the surfaces of said arms are disposed in flush relation with each other to be covered with a reinforcing member of electrically resistive material.

30. An electrode structure as claimed in claim 25, wherein said one surface of said central disc-shaped body and said legs constituting said disc-shaped portion and one of the surfaces of said arms are disposed in flush relation with each other to be covered with a reinforcing member of electrically resistive material.

31. An electrode structure as claimed in claim 26, wherein said one surface of said central disc-shaped body and said legs constituting said disc-shaped portion and one of the surfaces of said arms are disposed in flush relation with each other to be covered with a reinforcing member of electrically resistive material.

32. An electrode structure as claimed in claim 22, wherein said auxiliary electrode portion is coupled to said disc-shaped portion through an electrically resistive material.

33. An electrode structure as claimed in claim 23, wherein said auxiliary electrode portion is coupled to said disc-shaped portion through an electrically resistive material.

34. An electrode structure as claimed in claim 24, wherein said auxiliary electrode portion is coupled to said disc-shaped portion through an electrically resistive material.

35. An electrode structure as calimed in claim 25, wherein said auxiliary electrode portion is coupled to said disc-shaped portion through an electrically resistive material.

36. An electrode structure as claimed in claim 26, wherein said auxiliary electrode portion is coupled to said disc-shaped portion through an electrically resistive material.

37. An electrode structure as claimed in claim 27, wherein said auxiliary electrode portion is coupled to said disc-shaped portion through an electrically resistive material.

38. An electrode structure as claimed in claim 28, wherein said auxiliary electrode portion is coupled to said disc-shaped portion through an electrically resistive material.

39. An electrode structure as claimed in claim 29, wherein said auxiliary electrode portion is coupled to said disc-shaped portion through an electrically resistive material.

40. An electrode structure as claimed in claim 30, wherein said auxiliary electrode portion is coupled to said disc-shaped portion through an electrically resistive material.

41. An electrode structure as claimed in claim 31, wherein said auxiliary electrode portion is coupled to said disc-shaped portion through an electrically resistive material.

42. An electrode structure as claimed in claim 1, wherein said first self-acting magnetically driving means comprises a plurality of first slots extending from the central area of said dis-shaped portion to the outer peripheral edge of said annular portion to limit the direction of current flow, and werein said second self-acting magnetically driving means comprises a plurality of second slots disposed individually between said plural first slots and extending also from the central area of said disc-shaped portion to the inner peripheral edge of said annular portion to limit the direction of current flow.

43. An electrode structure as claimed in claim 1, wherein said second self-acting magnetically driving means provides for an arc current to flow between the arc point and a central portion of the recessed portion to enable driving of the arc produced at the recessed portion to shift the arc toward and on to said contact-making surface.

44. An electrode structure as claimed in claim 43, wherein said second self-acting magnetically driving means includes a substantially disc-shaped auxiliary electrode portion received in the recessed portion, the auxiliary electrode portion having the central portion thereof coupled to said disc-shaped portion.

* * * * *